US006389247B1

(12) United States Patent
Chung

(10) Patent No.: US 6,389,247 B1
(45) Date of Patent: May 14, 2002

(54) DEVICE AND METHOD FOR CONTROLLING FIXING TEMPERATURE IN IMAGE FORMING APPARATUS

(75) Inventor: Kyung-Shig Chung, Suwon-shi (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/718,383

(22) Filed: Nov. 24, 2000

(30) Foreign Application Priority Data

Mar. 9, 2000 (KR) ..... 2000-11774

(51) Int. Cl.[7] ..... G03G 15/20
(52) U.S. Cl. ..... 399/69; 399/44
(58) Field of Search ..... 399/44, 45, 46, 399/66, 67, 69

(56) References Cited

U.S. PATENT DOCUMENTS 5,646,717 A 7/1997 Hiroshima et al.
5,887,220 A * 3/1999 Nagaoka ..... 399/46
5,895,152 A 4/1999 Ide et al.

FOREIGN PATENT DOCUMENTS

JP 5-333746 * 12/1993
JP 8-262921 * 10/1996

* cited by examiner

*Primary Examiner*—Joan Pendegrass
(74) *Attorney, Agent, or Firm*—Robert E. Bushnell, Esq.

(57) ABSTRACT

A fixing temperature controlling process in an image forming apparatus. The resistance of a transfer roller is detected upon request of a fixing temperature control. It is determined which of fixing environment conditions set according to changes in fixing performance caused by environmental change the resistance belongs to. An optimal fixing temperature is detected for the determined fixing environment condition and the temperature of a fixer is controlled to the detected optimal fixing temperature.

18 Claims, 6 Drawing Sheets

| TRANSFER RESISTANCE | ENVIRONMENT CONDITION | TRANSFER VOLTAGE | FIXING TEMPERATURE |
|---|---|---|---|
| 1ST VALUE | HIGH TEMP–HIGH HUM | FIRST VOLTAGE | FIRST TEMPERATURE |
| 2ND VALUE | | | |
| 3RD VALUE | | | |
| ⋮ | | | |
| NTH VALUE | | | |
| N+1TH VALUE | ROOM TEMP–ROOM HUM | SECOND VOLTAGE | SECOND TEMPERATURE |
| ⋮ | | | |
| MTH VALUE | | | |
| M+1TH VALUE | LOW TEMP–LOW HUM | THIRD VOLTAGE | THIRD TEMPERATURE |
| ⋮ | | | |
| LTH VALUE | | | |

FIG. 2

| TRANSFER RESISTANCE | TRANSFER ENVIRONMENT CONDITION | TRANSFER VOLTAGE | FIXING ENVIRONMENT CONDITION | FIXING TEMPERATURE |
|---|---|---|---|---|
| 1ST VALUE | HIGH TEMP–HIGH HUM | FIRST VOLTAGE | HIGH TEMP–HIGH HUM | FIRST TEMPERATURE |
| 2ND VALUE | | | | |
| ⋮ | | | | |
| ATH VALUE | | | | |
| A+1TH VALUE | ROOM TEMP–ROOM HUM | SECOND VOLTAGE | | |
| ⋮ | | | | |
| BTH VALUE | | | | |
| B+1TH VALUE | | | ROOM TEMP–ROOM HUM | SECOND TEMPERATURE |
| ⋮ | | | | |
| CTH VALUE | | | | |
| C+1TH VALUE | | | LOW TEMP–LOW HUM | THIRD TEMPERATURE |
| ⋮ | | | | |
| DTH VALUE | | | | |
| D+1TH VALUE | LOW TEMP–LOW HUM | THIRD VOLTAGE | | |
| ⋮ | | | | |
| ETH VALUE | | | | |

FIG. 4

FIG. 6

| | DIVISION | SAMSUNG | HONGWON | LOTTE CANON | SPECIFIED FIXITY AT OR ABOVE 80% | CRINKLE = NO OCCURRENCE |
|---|---|---|---|---|---|---|
| FIG. 2 | HIGH TEMP–HIGH HUM | 92.1 | 99.3 | 97.0 | OK | NG |
| | ROOM TEMP–ROOM HUM | 82.8 | 99.6 | 77.8 | NG | OK |
| | LOW TEMP–LOW HUM | 93.2 | 99.7 | 100 | OK | OK |
| PRESENT INVENTION | HIGH TEMP–HIGH HUM | 96.2 | 99.0 | 98.0 | OK | OK |
| | ROOM TEMP–ROOM HUM | 89.6 | 100.1 | 98.5 | OK | OK |
| | LOW TEMP–LOW HUM | 93.2 | 98.5 | 97.0 | OK | OK |

DEVICE AND METHOD FOR CONTROLLING FIXING TEMPERATURE IN IMAGE FORMING APPARATUS

CLAIM OF PRIORITY

This application makes reference to, incorporates the same herein, and claims all benefits accruing under 35 U.S.C. § 119 from my application Fixing Temperature Control Method For Image Forming Apparatus filed with the Korean Industrial Property Office on the $9^{TH}$ day of the month of March 2000, and there duly assigned Ser. No. 2000-11774.

BACKGROUND OF THE INVENTION

1. Field of the Invention

The present invention relates generally to an image forming apparatus and processes using electrophotographic development, and in particular, to a device and process for controlling the fixing temperature in an effort to consistently form high quality images upon printable media.

2. Description of the Related Art

Electrophotographic development is widely used for an image forming apparatus like a copier, a laser beam printer, and a plain paper facsimile. The electrophotographic development is performed in the process of charging, exposure, development, transferring, and fixing in this sequential order. The results obtained from the transfer operation and the results obtained from the fixing operation vary differently as a function of environmental change. Nevertheless, the environmental conditions are classified into high temperature-high humidity, room temperature-room humidity, and low temperature-low humidity regardless of the difference between variations in the transfer performance and the fixing performance and the transfer voltage and the fixing temperature are determined according to the determined environmental condition. Since the environmental conditions are determined for the transfer performance, the fixing performance is not controlled appropriately with respect to environmental change. Room temp-room humidity ranges from 11° C. to 31° C. in temperature, for example. This temperature range is appropriately set for control of the transfer performance, but not for control of the fixing performance. Fixing is not reliably done at a temperature between 11° C. and 18° C. in the room temp-room humidity condition. Also, at a temperature between 27° C. to 31° C. the room temperature-room humidity condition is too high for reliable fixing and is accompanied by the phenomenon known as crinkling the paper (hereafter: crinkle).

I have noticed that typically, the fixer operation is controlled according to criteria set after considering only the changes of the transfer performance, despite the presence of differences in the variations of the transfer and fixing performances with changes in the environment ambient to the fixing operation. Consequently, it seems that fixing performance can not be effectively controlled in the presence of environmental change.

Incorporated by reference herein are U.S. Pat. No. 5,646,717 to Koichi Hiroshima et al. entitled Image forming Apparatus Having Charging Member and U.S. Pat. No. 5,895,152 to Atsushi Ide et al. entitled Fixing Device And Fixing Temperature Control Method, which describe the effects of temperature and humidity in image forming devices.

SUMMARY OF THE INVENTION

It is an object of the present invention to provide an improved image formation process and apparatus.

It is another object to provide an image formation process and apparatus for controlling the fixing temperature in an electrophotographic development type image forming apparatus.

It is still another object to provide an image formation process and apparatus using electrophotographic development, with the temperature of the fixing operation being controlled as a function of different classifications of variations in transfer performance and fixing performance.

It is yet another object to provide an image formation process and apparatus using electrophotographic development to consistently form high quality images upon printable media by controlling the temperature of the fixing operation in consideration of different variations in transfer performance and in the fixing performance as the ambient environment changes.

It is still yet another object to provide an image formation process and apparatus using electrophotographic development able to solve the problem of unreliable fixing when the fixing temperature is controlled according to a criterion that has been set with only changes in the transfer performance considered, by controlling the temperature of the fixing operation being in consideration of different variations in transfer performance and fixing performance as the ambient environment changes.

These and other objects of the present invention may be achieved by providing a fixing temperature controlling process in an image forming apparatus in order to consistently form high quality images upon printable media. The resistance of a transfer roller is detected upon request of a fixing temperature control. A determination is made of the fixing environment conditions, set according to changes in fixing performance caused by environmental change, the resistance belongs to. An optimal fixing temperature is detected for the determined fixing environment condition and the temperature of a fixer is controlled to the detected optimal fixing temperature.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 2 is an exemplary transfer voltage-fixing temperature control table based on transfer resistance values;

FIG. 4 is a transfer voltage-fixing temperature control table of values based on transfer resistance values for an embodiment of the principles of the present invention;

FIG. 6 is a table listing the results of a test on fixity and the crinkle phenomenon after a comparison between the exemplary technology and the embodiments of the principles of the present invention.

DETAILED DESCRIPTION OF THE PREFERRED EMBODIMENT

Figure 1:
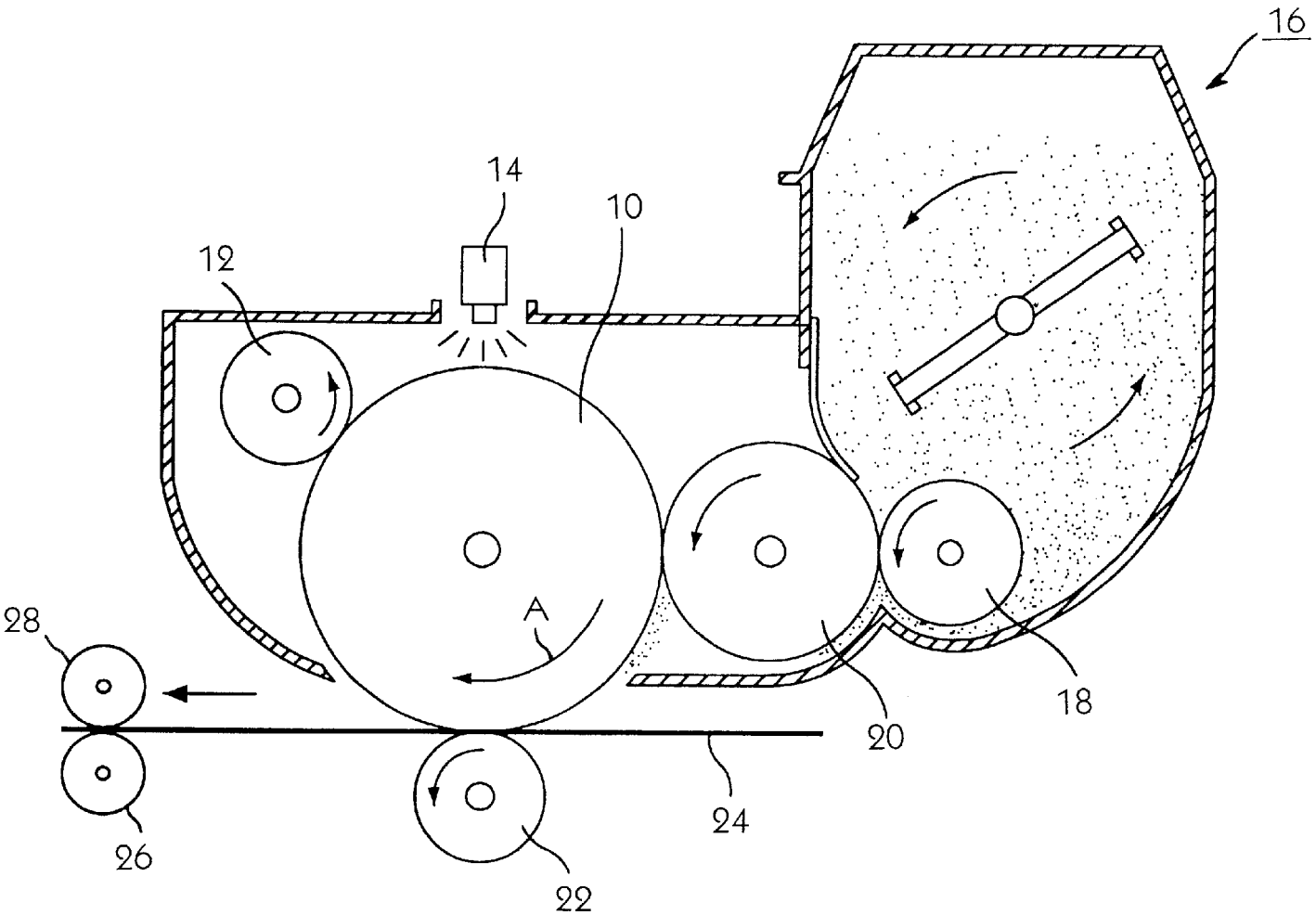
FIG. 1 is a view schematically illustrating a printer engine mechanism of an exemplary image forming apparatus.

Turning now to the drawings, FIG. 1 illustrates a schematic engine mechanism of an image forming apparatus using the electrophotographic development process. In FIG. 1, a photosensitive drum 10 rotates in a direction indicated, by arrow A, by an engine driving motor (not shown) that is a main motor of an engine unit in the course of the electrophotographic development. The surface of photosensitive drum 10 is charged by rotating while in contact with a charge roller 12 to which a charge voltage has been applied. During charging, a sheet 24 of a printable medium such as a cut sheet of paper, is fed from a feeding device (not shown). Then, exposer 14 starts to expose the surface of photosensitive drum 10 to form an electrostatic image corresponding to text or image data on photosensitive drum 10. To develop the electrostatic image, a supply roller 18 supplies developer (toner) from a developer supply 16 to a development roller 20 charged with a development voltage. The developer is transferred to the exposed portion of photosensitive drum 10 from a development location where development roller 20 is near to photosensitive drum 10. After the development is completed, the transferring step starts. A transfer roller 22, charged with a transfer voltage, transfers the developer on photosensitive drum 10 to paper sheet 24 at a transfer location where transfer roller 22 is nearest to photosensitive drum 10. A fixing unit includes a pressure roller 26 and a heat roller 28, and fixes the developer onto paper sheet 24 by applying pressure and heat onto the developer-transferred paper sheet 24. Then, the paper sheet 24 is discharged to the exterior of the image forming apparatus. In this manner, a sheet of paper may be either copied or printed with images.

The transfer performance of transfer roller 22 and the fixing performance of the fixing unit 26, 28, vary depending on temperature, humidity, paper thickness, and environmental factors. The transfer performance and the fixing performance are set constant by controlling a transfer voltage and a fixing temperature according to environmental change. Environmental change should be sensed to control a transfer voltage and a fixing temperature against the environmental change. For this purpose, the resistance of transfer roller 22 is detected to sense temperature and humidity based on the principle that the resistance of transfer roller 22 varies with temperature and humidity. Paper thickness may also be measured when setting a printer driver. According to temperature, humidity, and the paper thickness sensed, a current state or environmental condition, as shown in FIG. 2, is classified as being either a high temperature-high humidity (high temperature-high humidity), room temperature-room humidity (room temp-room humidity), and low temperature-low humidity (low temperature-low humidity) state, and the transfer voltage and the fixing temperature are controlled based on the current classification of the state of environmental conditions.

Changes in transfer performance and fixing performance will be described in the following paragraphs, for the sake of convenience, by reference to changes of temperature and humidity only. An exemplary process for controlling a transfer voltage and a fixing temperature according to the resistance of a transfer roller only, will now be described with reference to the table of values shown in FIG. 2. If a transfer resistance is between a $1^{ST}$ value and an $N^{TH}$ value that define a high temperature-high humidity condition, a main controller in a printer supplies a first voltage to a transfer roller for optimal transfer performance and sets the temperature of a fixer to a first temperature for optimal fixing performance. If the transfer resistance is between an $(N+1)^{TH}$ value and an $M^{TH}$ value that define a room temperature-room humidity condition, the main controller supplies a second voltage to the transfer roller for optimal transfer performance and sets the temperature of the fixer to a second temperature for optimal fixing performance. If the transfer resistance is between an $(M+1)^{TH}$ value and an $L^{TH}$ value that define a low temperature-low humidity condition, the main controller supplies a third voltage to the transfer roller for optimal transfer performance and sets the temperature of the fixer to a third temperature for optimal fixing performance.

The transfer performance and the fixing performance vary differently with environmental change. Nevertheless, the environmental conditions are classified into high temperature-high humidity, room temperature-room humidity, and low temperature-low humidity regardless of the difference between variations in the transfer performance and the fixing performance and the transfer voltage and the fixing temperature are determined according to the determined environmental condition. Since the environmental conditions are determined for the transfer performance, the fixing performance is not controlled appropriately with respect to environmental change. Room temperature-room humidity ranges from between approximately 11° C. to 31° C. in temperature, for example. This temperature range is appropriately set for control of the transfer performance, but not for control of the fixing performance. Fixing is not usually expected to be reliably accomplished at a temperature between approximately 11° C. and 18° C. in the room temperature-room humidity condition. Also, at a temperature between approximately 27° C. to 31° C., the room temperature-room humidity condition is too high for reliable fixing and is accompanied by a phenomenon often referred to as crinkle. As described above, a fixer is controlled according to criteria set in consideration for the changes of the transfer performance only despite different variations in the transfer and fixing performances with respect to environmental change. Consequently, the fixing performance cannot be effectively controlled against the environmental change.

Figure 3:
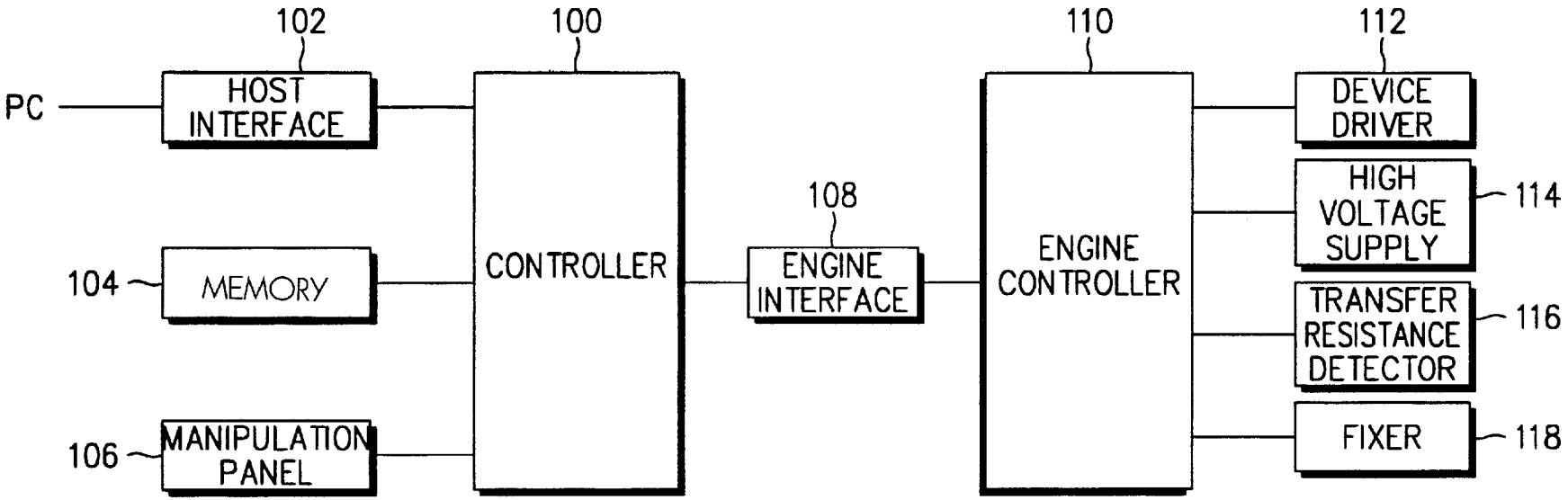
FIG. 3 is a schematic block diagram of a printer that suitable for the practice of the principles of the present invention.

A preferred embodiment of the present invention will be described below with reference to the accompanying drawings. In the following description, well-known functions or constructions are not described in detail since they would obscure the invention in unnecessary detail. Refer then to FIG. 3, a schematic block diagram of an image forming apparatus employing electrophotographic development, which is suitable for the practice of the principles of the present invention. Controller 100 provides overall control to the operation of the image forming apparatus, such as a printer. A host interface 102 interfaces between a host like personal computer (PC) and the controller 100. A memory 104 temporarily stores data generated while the controller 100 executes control programs as well as stores the control programs and various data of controller 100. A manipulation panel 106 includes a key pad for entering various user commands and a display for providing various pieces of information to the user. Engine interface 108 interfaces controller 100 and an engine controller 110. Engine controller 110 provides overall control to the operation of a printer engine. A device driver 112 drives devices in the printer engine under control of engine controller 110. A high voltage supply 114 supplies a high voltage to a charge roller, a development roller, and a transfer roller in the printer engine under the control of engine controller 110. A transfer resistance detector 116 provides the resistance value of the transfer roller upon request from engine controller 110. A fixer 118 fixes a printed image at a fixing temperature under the controller of engine controller 110. Particularly, engine controller 110 changes the fixing temperature to prevent abnormal operations of fixer 118 with respect to environmental change according to the preferred embodiment of the present invention. The engine controller 110 controls the fixing temperature by referring to the table of values shown in FIG. 4.

Referring to FIG. 4, the fixing environmental conditions of high temperature-high humidity, room temperature-room humidity, and low temperature-low humidity are set separately from the transfer environment conditions according to changes in the fixing performance. The temperature between approximately 11° C. to 18° C. corresponding to the room temperature-room humidity condition of FIG. 2 is now classified as a low temperature-low humidity condition with respect to the fixing environment condition in FIG. 4. Then, the temperature of fixer 118 is controlled to a third temperature appropriate for the low temperature-low humidity condition. Therefore, the degradation of the fixing performance can be prevented that would occur if the temperature range between approximately 11° C. to 18° C. were classified as room temperature-room humidity. The temperature between approximately 27° C. to 31° C. corresponding to the room temperature-room humidity of FIG. 2 is now classified a high temperature-high humidity condition with respect to the fixing environment condition in FIG. 4. Then, the temperature of fixer 118 is controlled to a first temperature appropriate for the high temperature-high humidity condition. Therefore, crinkle observed at too high a fixing temperature can be prevented. The fixing environment condition classification data are empirically obtained. FIG. 4 also illustrates the transfer voltages applied to the transfer roller with respect to the detected transfer resistance.

Figure 5:
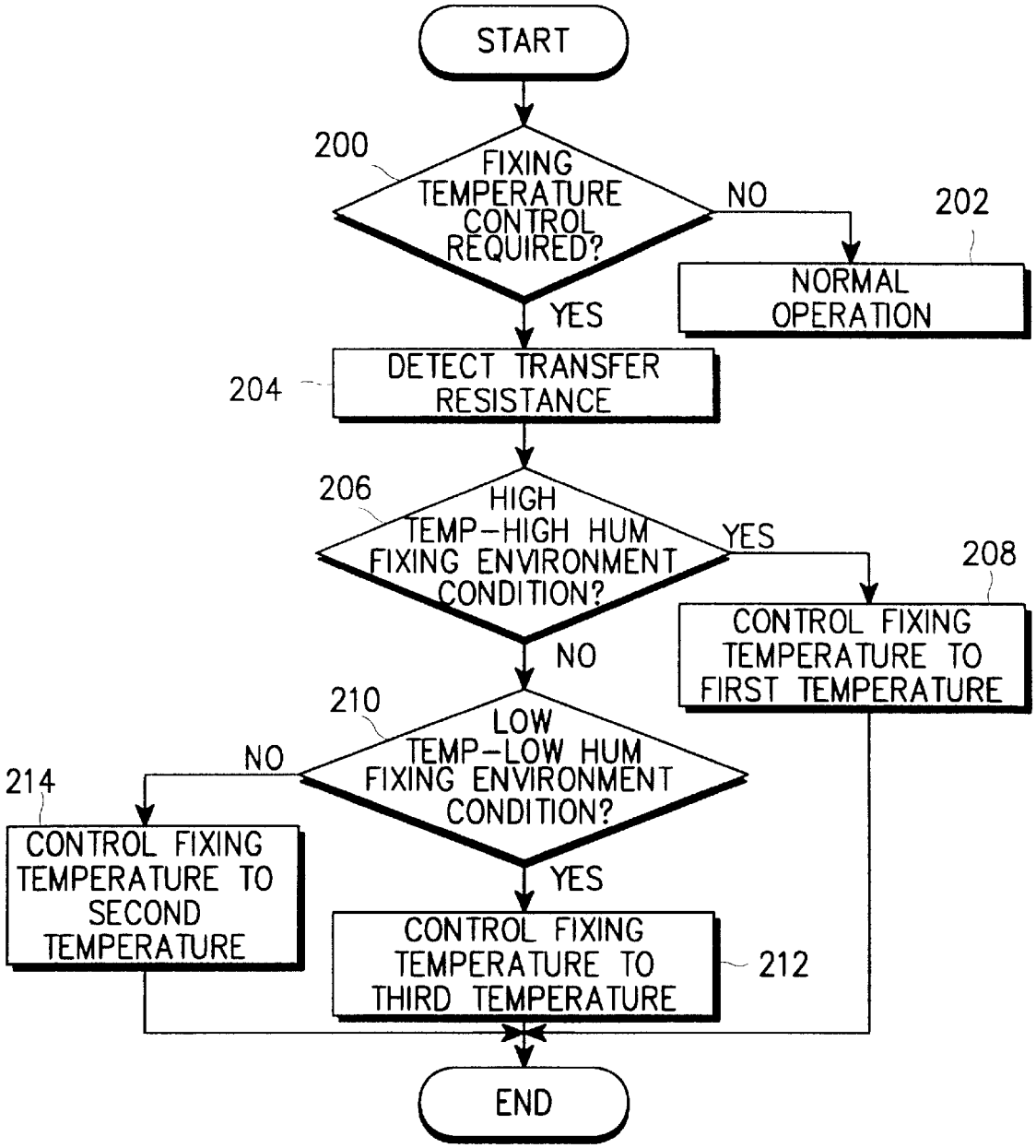
FIG. 5 is a flowchart illustrating a fixing temperature controlling process performed according to the principles of the present invention.

A fixing temperature controlling process according to the preferred embodiment of present invention will be described referring to FIG. 5. Engine controller 110 determines whether controller 100 has requested a fixing temperature control for printing or warming-up in step 200. Upon request of the fixing temperature control, engine controller 110 proceeds to step 204, and otherwise, it performs a normal operation in step 202. In step 204, engine controller 110 detects a transfer resistance through transfer resistance detector 116. The transfer resistance is detected in a well-known process and thus its detailed description is avoided here. Then, engine controller 110 refers to the table shown by FIG. 4 to determine whether the detected transfer resistance is between a $1^{ST}$ value and a $B^{TH}$ value indicative of the high temperature-high humidity fixing environment condition. If the transfer resistance is in the high temperature-high humidity range with respect to the fixing environment condition, engine controller 110 controls the fixing temperature to the first temperature that is an optimal fixing temperature at high temperature-high humidity in step 208. If the transfer resistance is not in the high temperature-high humidity range, enginecontroller 110 determines whether the transfer resistance is between a $C+1^{TH}$ value and an $E^{TH}$ value indicative the low temperature-low humidity fixing condition with respect to the fixing environment condition. If the transfer resistance is in the low temperature-low humidity range with respect to the fixing environment condition, engine controller 110 controls the fixing temperature to a third temperature that is an optimal fixing temperature for the low temp-low humidity fixing condition in step 212. Otherwise the transfer resistance is between a $B+1^{TH}$ value and an $C^{TH}$ value, and engine controller 110 controls the fixing temperature to a second temperature that is an optimal fixing temperature for the room temperature-room humidity fixing condition with respect to the fixing environment condition in step 214.

FIG. 6 is a table showing the results of a test of fixing in several printer models according to the preferred embodiment of the present invention as compared to the prior on fixity and crinkle occurrence. Referring to FIG. 6, fixity is NG (no good) at room temperature-room humidity and crinkle is observed (NG) at high temperature-high humidity in the prior art, while the specifications are met in all cases in the present invention.

The foregoing paragraphs describe an image formation process and apparatus using electrophotographic development able to solve the problem of unreliable fixing when the fixing temperature is controlled according to a criterion that has been set with only changes in the transfer performance considered, by the expedient of controlling the temperature of the fixing operation as a function of different variations in transfer performance and in fixing performance as the ambient environment changes. The fixing operation can be reliably performed to provide a consistently acceptable image on a printable media during ambient environmental change by controlling a fixing temperature according to a fixing environment condition that is set considering changes in fixing performance with respect to the environmental change in the present invention.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A fixing temperature controlling process in an image forming apparatus, comprising the steps of:

detecting the resistance of a transfer roller upon request of a fixing temperature control;

determining which of several fixing environment conditions, set according to changes in fixing performance caused by environmental change, the resistance belongs to; and detecting an optimal fixing temperature for the determined fixing environment condition and controlling the temperature of a fixer to the detected optimal fixing temperature.

2. The fixing temperature controlling process of claim 1, wherein the fixing environment conditions are high temperature-high humidity, room temperature-room humidity, and low temperature-low humidity.

3. The fixing temperature controlling process of claim 1, wherein each fixing environment condition is different in transfer resistance range from a corresponding transfer environment condition set according to changes in transfer performance caused by the environmental change.

4. A fixing temperature controlling process in an image forming apparatus having a transfer roller and a fixing roller and fixing and transfer environment conditions separately classified according to transfer resistance values, comprising the steps of:

detecting the transfer resistance of the transfer roller;

determining a fixing environment condition based on the detected transfer resistance; and controlling the fixer roller to a fixing temperature corresponding to the determined fixing environment condition.

5. The fixing temperature controlling process of claim 4, wherein the determined fixing environment condition is one corresponding to high temperature-high humidity, room temperature-room humidity, or low temperature-low humidity.

6. The fixing temperature controlling process of claim 4, wherein the fixing environment condition corresponds to transfer resistance range different from a transfer resistance range corresponding to an equivalent transfer environment condition.

7. The fixing temperature controlling process of claim 4, further comprising the step of reading a transfer voltage based on the detected transfer resistance from a memory and supplying the transfer voltage to the transfer roller.

8. A fixing temperature controlling device in an image forming apparatus having a transfer roller and a fixing roller, comprising:

a transfer resistance detector for detecting the transfer resistance of the transfer roller; and an engine controller for setting fixing environment conditions and transfer environment conditions separately according to transfer resistance values, determining a fixing environment condition based on the detected transfer resistance, and controlling the fixing roller to a fixing temperature corresponding to the determined fixing environment condition.

9. The fixing temperature controlling device of claim 8, wherein the environment conditions are high temperature-high humidity, room temperature-room humidity, and low temperature-low humidity.

10. The fixing temperature controlling device of claim 8, wherein each fixing environment condition corresponds to transfer resistance range different from a transfer resistance range corresponding to an equivalent transfer environment condition.

11. The fixing temperature controlling device of claim 8, wherein the engine controller reads a transfer voltage, based on the detected transfer resistance, from a memory and supplies the transfer voltage to the transfer roller.

12. A fixing temperature controlling device in an image forming apparatus having a transfer roller and a fixing roller, comprising:

a memory for storing separate optimal transfer voltages and fixing temperatures for fixing and transfer environment conditions independently set according to transfer resistance values of the transfer roller, wherein the fixing and transfer environment conditions are high temperature-high humidity, room temperature-room humidity, and low temperature-low humidity;

a transfer resistance detector for detecting the transfer resistance of the transfer roller; and an engine controller for reading an optimal fixing temperature from the memory based on the detected transfer resistance and controlling the fixer roller to the fixing temperature.

13. The fixing temperature controlling device of claim 12, wherein the high temperature-high humidity transfer environment condition corresponds to a 1st-Ath range of detected transfer resistances, the room temperature-room humidity transfer environment condition corresponds to an A+1th-Dth range of detected transfer resistances, the low temperature-low humidity transfer environment condition corresponds to a D+1th-Eth range of detected transfer resistances, the high temperature-high humidity fixing environment condition corresponds to a 1st-Bth range of detected transfer resistances, the room temperature-room humidity fixing environment condition corresponds to an B+1th-Cth range of detected transfer resistances, and the low temperature-low humidity fixing environment condition corresponds to a C+1th-Eth range of detected transfer resistances.

14. The fixing temperature controlling device of claim 12, wherein the engine controller reads an optimal transfer voltage based on the detected transfer resistance from the memory and supplies the transfer voltage to the transfer roller.

15. The fixing temperature controlling device of claim 12, wherein each fixing environment condition corresponds to a transfer resistance range different from a transfer resistance range corresponding to an equivalent transfer environment condition.

16. A fixing temperature controlling device in an image forming apparatus having a transfer roller and a fixing roller, comprising:

a memory for storing a plurality of transfer resistance values, first, second and third transfer voltages corresponding to respective ranges of said transfer resistance values, and first, second and third fixing temperatures corresponding to different respective ranges of said transfer resistance values;

a transfer resistance detector for detecting the transfer resistance value of the transfer roller; and an engine controller for controlling the fixer roller to the fixing temperature corresponding to the detected transfer resistance value, and for applying to the transfer roller the transfer voltage corresponding to said detected transfer resistance value.

17. The fixing temperature controlling device of claim 16, wherein the first fixing temperature corresponds to a first range of transfer resistance values indicative of a high temperature-high humidity fixing environment condition, the second fixing temperature corresponds to a second range of transfer resistance values indicative of a room temperature-room humidity fixing environment condition, and the third fixing temperature corresponds to a third range of transfer resistance values indicative of a low temperature-low humidity fixing environment condition.

18. The transfer voltage controlling device of claim 17, wherein the first transfer voltage corresponds to a fourth range of transfer resistance values indicative of a high temperature-high humidity transfer environment condition, the second transfer voltage corresponds to a fifth range of transfer resistance values indicative of a room temperature-room humidity transfer environment condition, and the third transfer voltage corresponds to a sixth range of transfer resistance values indicative of a low temperature-low humidity transfer environment condition, said fourth range of transfer resistance values includes a portion of said first range of transfer resistance values, said fifth range of transfer resistance values includes said second range of transfer resistance values and a portion of said first and third ranges of transfer resistance values, and said sixth range of transfer resistance values includes a portion of said third range of transfer resistance values.

* * * * *